US012565756B2

(12) United States Patent
Satoh et al.

(10) Patent No.: US 12,565,756 B2
(45) Date of Patent: Mar. 3, 2026

(54) WORK MACHINE AND INFORMATION PROCESSING DEVICE

(71) Applicant: SUMITOMO HEAVY INDUSTRIES, LTD., Tokyo (JP)

(72) Inventors: Keisuke Satoh, Yokosuka (JP); Ayano Shinato, Yokosuka (JP); Homare Shibata, Yokosuka (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 181 days.

(21) Appl. No.: 18/498,082

(22) Filed: Oct. 31, 2023

(65) Prior Publication Data

US 2024/0150997 A1 May 9, 2024

(30) Foreign Application Priority Data

Nov. 9, 2022 (JP) ..... 2022-179194

(51) Int. Cl.
*E02F 9/20* (2006.01)
*E02F 9/22* (2006.01)
*E02F 9/26* (2006.01)

(52) U.S. Cl.
CPC ..... *E02F 9/2025* (2013.01); *E02F 9/22* (2013.01); *E02F 9/267* (2013.01)

(58) Field of Classification Search
CPC . E02F 9/2025; E02F 9/22; E02F 9/267; E02F 9/2054; E02F 9/20
See application file for complete search history.

(56) References Cited

U.S. PATENT DOCUMENTS

2018/0328003 A1* 11/2018 Tsukamoto ..... E02F 9/2242
2021/0012163 A1* 1/2021 Li ..... E02F 9/261
2021/0158409 A1 5/2021 Minemura
2022/0154424 A1 5/2022 Indoh

FOREIGN PATENT DOCUMENTS

JP H11247230 * 9/1999 ..... E02F 3/437
JP 2017071982 A * 4/2017 ..... E02F 9/2271
JP 2022-154722 A 10/2022

OTHER PUBLICATIONS

English translation of Narikawa et al. (JP 2017071982) (Year: 2017).*
English translation of Sanjibu et al. (JP H11247230) (Year: 1999).*
European search report of EP Application No. 23205952.7 Mailed on May 17, 2024.

* cited by examiner

*Primary Examiner* — Kyle J Kingsland
(74) *Attorney, Agent, or Firm* — WTA IP Law P.C.

(57) ABSTRACT

A work machine includes a machine body having a work element, and a control unit that controls an operation of the machine body based on a degree of priority among work efficiency, energy consumption efficiency, and metal fatigue damage.

15 Claims, 5 Drawing Sheets

WORK MACHINE AND INFORMATION PROCESSING DEVICE

CROSS-REFERENCE TO RELATED APPLICATIONS

This application claims priority to Japanese Patent Application No. 2022-179194, filed on Nov. 9, 2022, which is incorporated by reference herein in its entirety.

BACKGROUND

Technical Field

A certain embodiment of the present invention relates to a work machine and an information processing device.

Description of Related Art

In a work machine such as an excavator, the related art discloses a technique of setting, in a case where an excavation operation is automatically performed by a machine control function, a target trajectory of a bucket in consideration of a degree of priority between work efficiency and energy consumption efficiency.

SUMMARY

A work machine according to an embodiment of the present invention includes a machine body having a work element, and a control unit that controls an operation of the machine body based on a degree of priority among work efficiency, energy consumption efficiency, and metal fatigue damage.

DETAILED DESCRIPTION

The operation of the work machine is controlled more usefully in a case where metal fatigue damage can be taken into consideration.

The present invention has been made in view of the above circumstances, and it is desirable to suitably control an operation of a work machine.

Hereinafter, an embodiment of the present invention will be described in detail with reference to the drawings.

Excavator Configuration

Figure 1:
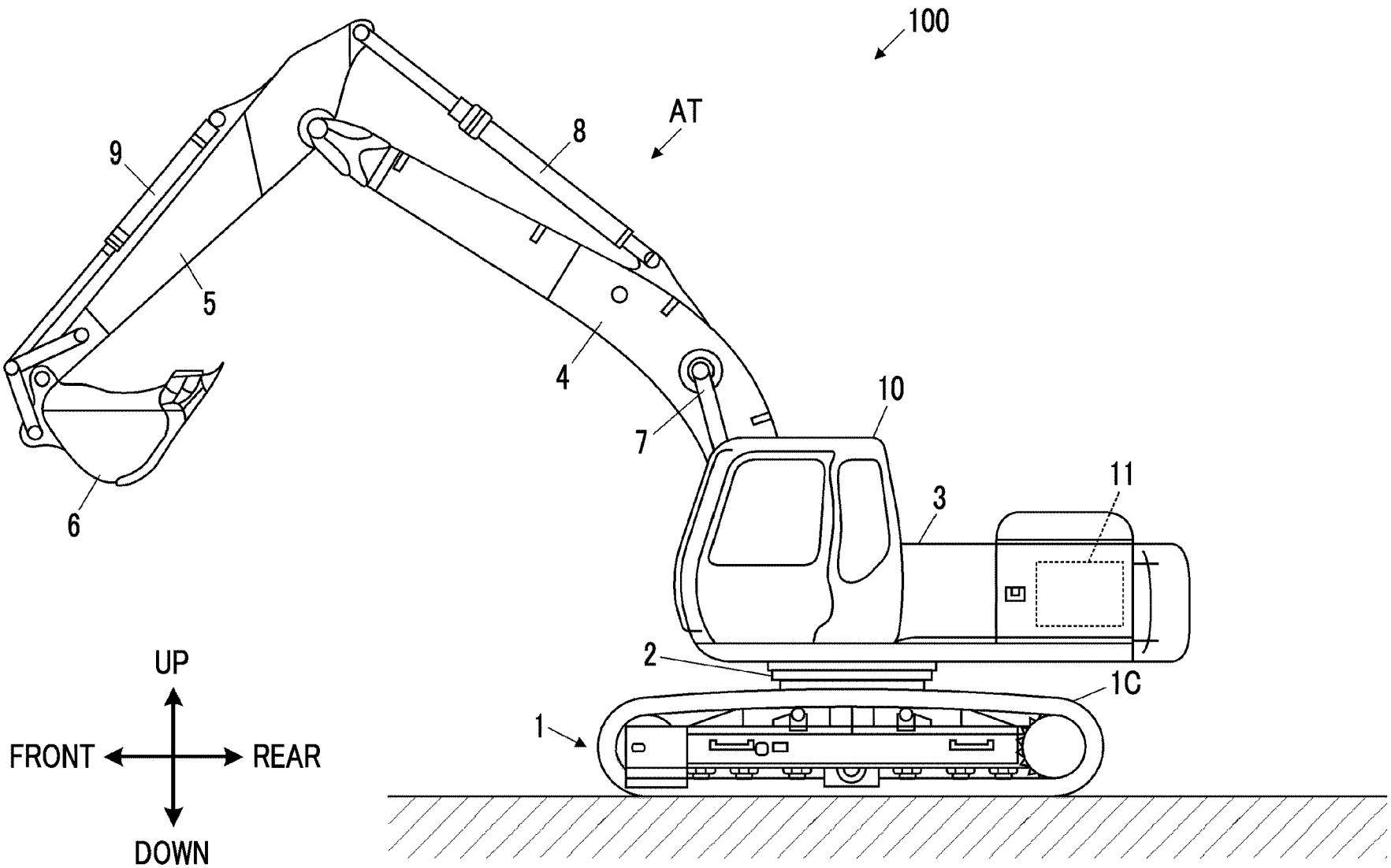
FIG. 1 is a side view of an excavator according to an embodiment of the present invention.
Figure 2:
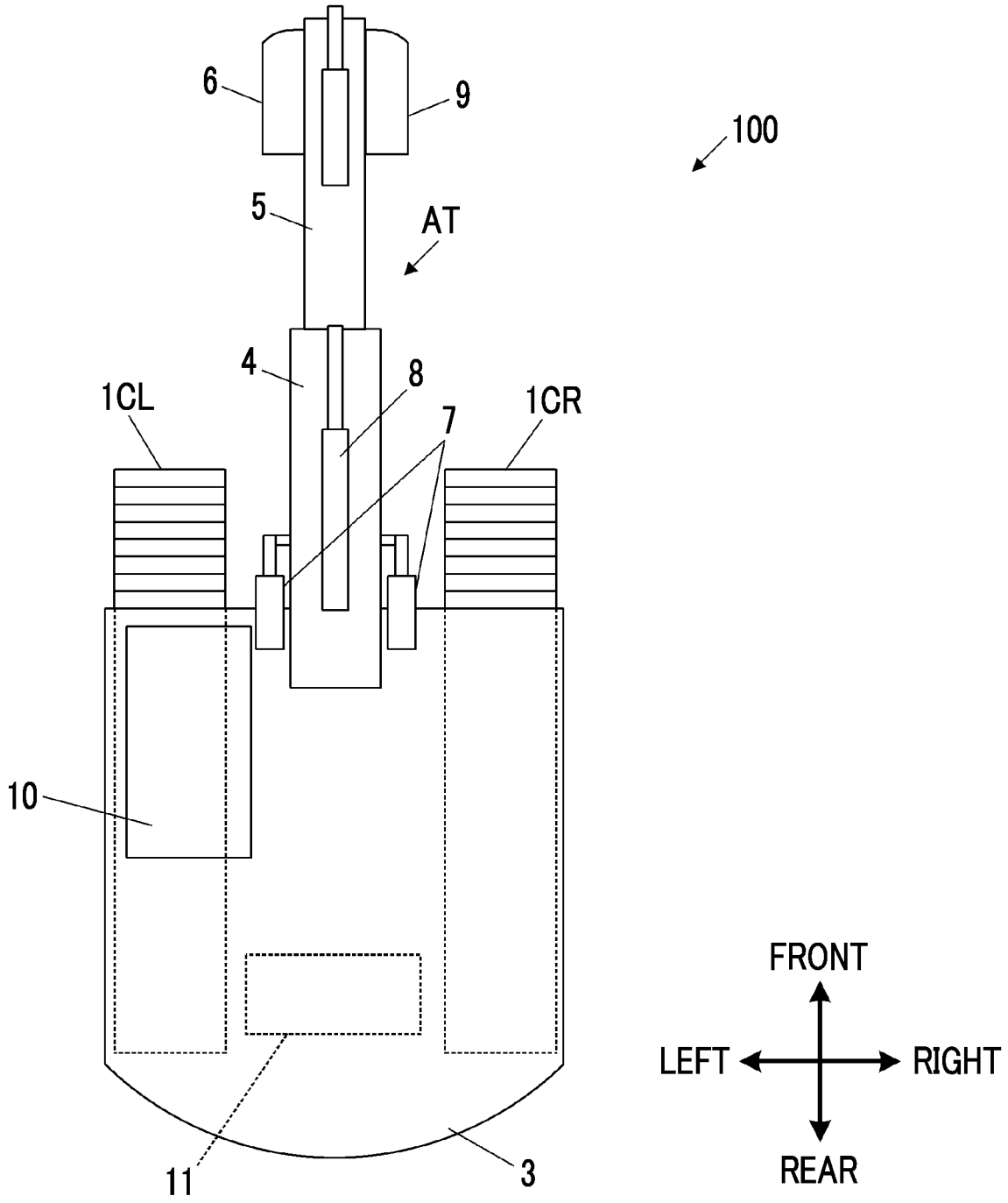
FIG. 2 is a plan view of the excavator according to an embodiment of the present invention.

FIGS. 1 and 2 are a side view and a plan view of an excavator 100 according to the present embodiment.

As shown in these figures, the excavator 100 according to the present embodiment is an example of a work machine according to an embodiment of the present invention, and is provided with a lower traveling body 1, a rotating platform 3 mounted on the lower traveling body 1 turnably via a turning mechanism 2, an attachment AT for performing various types of work, and a cabin 10.

Hereinafter, a front side of the excavator 100 (rotating platform 3) corresponds to a direction in which the attachment with respect to the rotating platform 3 extends in a case where the excavator 100 is viewed in a plan view (top view) from directly above along a turning axis of the rotating platform 3. Further, a left side and a right side of the excavator 100 (rotating platform 3) correspond to a left side and a right side as viewed from an operator seated in a cab seat in the cabin 10, respectively.

Further, in the following, the lower traveling body 1, the turning mechanism 2, the rotating platform 3, and the attachment AT may be referred to as a vehicle body BD (an example of machine body) of the excavator 100.

For example, the lower traveling body 1 includes a pair of left and right crawlers 1C. With hydraulic drive of each crawler 1C by a traveling hydraulic motor, the lower traveling body 1 causes the excavator 100 to travel.

With hydraulic drive of the turning mechanism 2 by a turning hydraulic motor, the rotating platform 3 turns with respect to the lower traveling body 1.

The attachment AT (an example of work element) includes a boom 4, an arm 5, and a bucket 6.

The boom 4 is attached to a center of a front portion of the rotating platform 3 to be vertically movable, the arm 5 is attached to a tip of the boom 4 to be rotatable up and down, and the bucket 6 is attached to a tip of the arm 5 to be rotatable up and down.

The boom 4, the arm 5, and the bucket 6 are hydraulically driven by a boom cylinder 7, an arm cylinder 8, and a bucket cylinder 9, as hydraulic actuators, respectively.

The bucket 6 is an example of an end attachment. The bucket 6 is used, for example, for excavation work. Further, another end attachment may be attached to the tip of the arm 5, instead of the bucket 6, depending on a work content or the like. The another end attachment may be, for example, another type of bucket such as a large bucket, a bucket for slope, or a bucket for dredging. Further, the another end attachment may be the end attachment having a type other than the bucket such as a stirrer, a breaker, or a grapple.

The cabin 10 is a cab on which the operator is boarded, and is mounted on, for example, a left side of the front portion of the rotating platform 3. The excavator 100 causes the actuator to operate in response to a manipulation of the operator boarding the cabin 10 to drive driven elements such as the lower traveling body 1, the rotating platform 3, the boom 4, the arm 5, and the bucket 6.

The excavator 100 may have a configuration in which at least a part of the driven elements, such as the lower traveling body 1, the rotating platform 3, the boom 4, the arm 5, and the bucket 6, is electrically driven. That is, the excavator 100 may be a hybrid excavator, an electric excavator, or the like in which a part of the driven elements is driven by an electric actuator.

Further, the excavator 100 may be configured to be remotely manipulated from an outside of the excavator 100 (for example, a management device 200 or a terminal device 300 described below), instead of (or in addition to) being configured to be manipulated by the operator of the cabin 10. In a case where the excavator 100 is remotely manipulated, the inside of the cabin 10 may be in an unmanned state.

Hereinafter, the manipulation of the operator includes at least one of a manipulation of a manipulation device 45 by the operator of the cabin 10 or a remote manipulation by an external operator.

Further, the excavator 100 may cause the actuator to automatically operate regardless of a content of the manipulation of the operator. Accordingly, the excavator 100 realizes a function of causing at least a part of the driven elements, such as the lower traveling body 1, the rotating platform 3, the boom 4, the arm 5, and the bucket 6, to automatically operate, that is, a so-called "automatic operation function" or "machine control function".

The automatic operation function may include a function of causing a driven element other than the driven element (actuator) to be manipulated to automatically operate in response to the manipulation or the remote manipulation of the manipulation device 45 by the operator, that is, a so-called "semi-automatic operation function" or "manipulation-support type machine control function". Further, the automatic operation function may include a function of causing at least a part of the plurality of driven elements to automatically operate on the premise that there is no manipulation or remote manipulation of the manipulation device 45 by the operator, that is, a so-called "fully automatic operation function" or "fully automatic machine control function". In a case where the fully automatic operation function is enabled in the excavator 100, the inside of the cabin 10 may be in an unmanned state. Further, the semi-automatic operation function, the fully automatic operation function, or the like may include a mode in which an operation content of the driven element to be automatically operated is automatically decided in accordance with a predetermined rule. Further, the semi-automatic operation function, the fully automatic operation function, or the like may include a mode (so-called "autonomous operation function") in which the excavator 100 autonomously makes various types of determination and the operation content of the driven element (hydraulic actuator) to be automatically operated is autonomously decided based on determination results.

Figure 3:
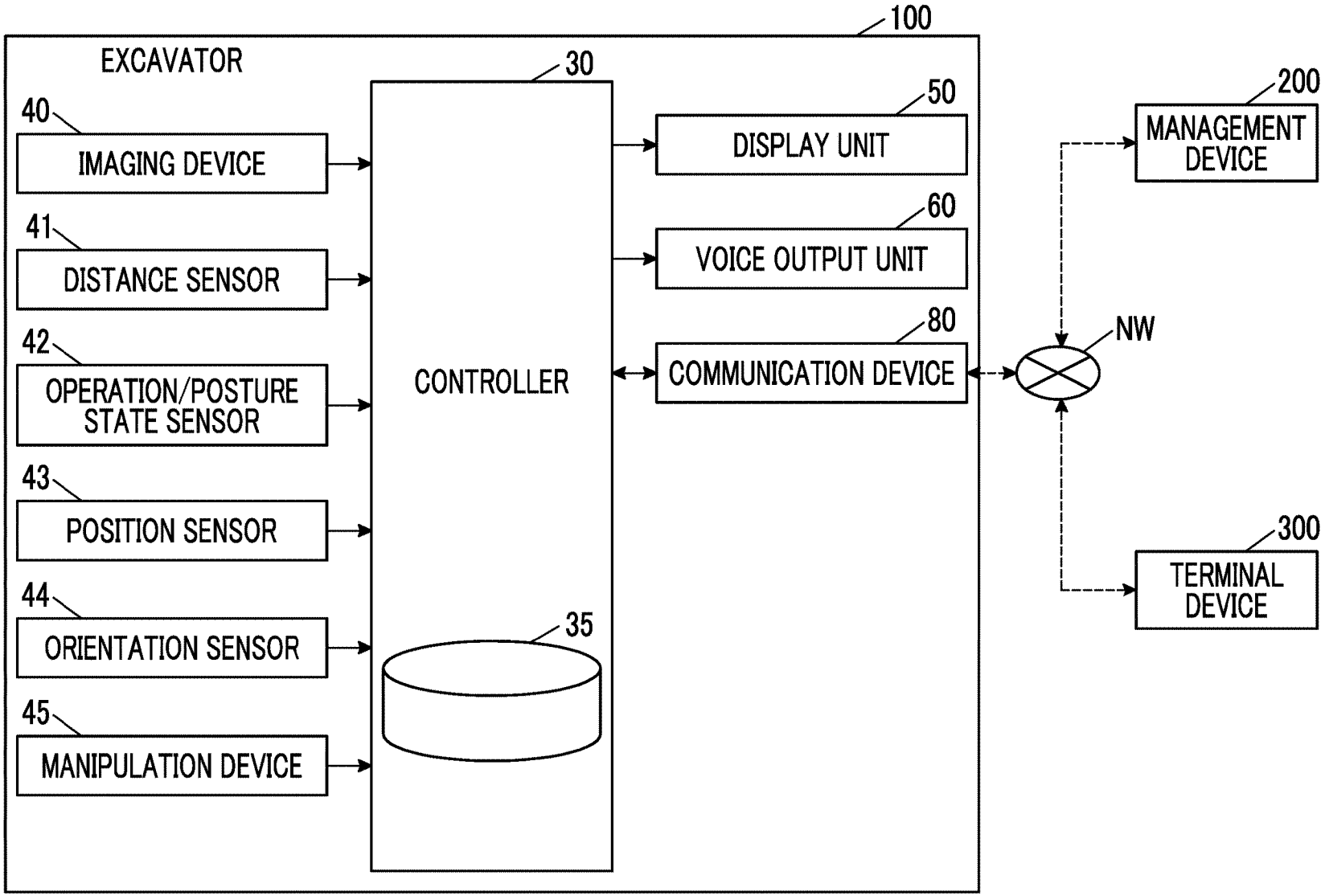
FIG. 3 is a block diagram showing a schematic control configuration of the excavator according to an embodiment of the present invention.

FIG. 3 is a block diagram showing a schematic control configuration of the excavator 100.

As shown in this figure, the excavator 100 is provided with an imaging device 40, a distance sensor 41, an operation/posture state sensor 42, a position sensor 43, an orientation sensor 44, the manipulation device 45, a display unit 50, a voice output unit 60, a communication device 80, and a controller 30, in addition to the above-described configuration.

The imaging device 40 captures an image of the periphery of the excavator 100 and outputs the image to the controller 30. For example, the imaging device 40 includes a rear camera for imaging a rear side of the excavator 100, a left camera for imaging a left side thereof, and a right camera for imaging a right side thereof. Each imaging device 40 is installed such that an optical axis faces obliquely downward, and has an imaging range (angle of field) in a vertical direction including a distance from the ground near the excavator 100 to a distance place of the excavator 100.

The distance sensor 41 is distance measuring means that measures a distance to an object near the excavator 100 and acquires information of the distance (two-dimensional or three-dimensional distance information), and outputs the acquired information to the controller 30. For example, the distance sensor 41 is provided such that three sides of the rear side, the left side, and the right side of the excavator 100 can be measured in correspondence with the imaging device 40.

The operation/posture state sensor 42 is a sensor that detects an operation state or a posture state of the excavator 100, and outputs a detection result to the controller 30. The operation/posture state sensor 42 includes a boom angle sensor, an arm angle sensor, a bucket angle sensor, a triaxial inertial measurement unit (IMU) sensor, a turning angle sensor, and an acceleration sensor.

These sensors may be configured of a stroke sensor for a cylinder such as a boom, or a sensor such as a rotary encoder for acquiring rotation information, or may be replaced by acceleration (which may include speed and position) acquired by the IMU.

The arm angle sensor detects a rotation angle (hereinafter referred to as "arm angle") of the arm 5 with respect to the boom 4.

The bucket angle sensor detects a rotation angle (hereinafter referred to as "bucket angle") of the bucket 6 with respect to the arm 5.

The IMU is attached to each of the boom 4 and the arm 5, and detects the acceleration of the boom 4 and the arm 5 along predetermined three axes and angular acceleration of the boom 4 and the arm 5 around the predetermined three axes.

The turning angle sensor detects a turning angle with respect to a predetermined angular direction of the rotating platform 3. However, the present invention is not limited thereto, and the turning angle may be detected based on a GPS or an IMU sensor provided in the rotating platform 3.

The acceleration sensor is attached to a position away from the turning axis of the rotating platform 3, and detects the acceleration of the rotating platform 3 at the position. Accordingly, based on a detection result of the acceleration sensor, it is possible to determine whether the rotating platform 3 turns, whether the lower traveling body 1 travels, or the like.

The position sensor 43 is a sensor that acquires information on a position (current position) of the excavator 100, and is a global positioning system (GPS) receiver in the present embodiment. The position sensor 43 receives a GPS signal including the position information of the excavator 100 from a GPS satellite, and outputs the acquired position information of the excavator 100 to the controller 30. The position sensor 43 may not be the GPS receiver as long as the position information of the excavator 100 can be acquired, and may be, for example, a sensor that uses a satellite positioning system other than the GPS.

The orientation sensor 44 is a sensor that acquires information on an orientation (direction) in which the excavator 100 faces, and is, for example, a geomagnetic sensor. The orientation sensor 44 acquires the orientation information of the excavator 100 and outputs the information to the controller 30. The orientation sensor 44 only needs to be able to acquire the orientation information of the excavator 100, and a sensor type thereof is not particularly limited. For example, two GPS receivers may be provided, and the orientation information may be acquired from a difference in pieces of position information of the two GPS receivers.

The manipulation device 45 is a manipulation unit which is provided near the cab seat of the cabin 10 and by which the operator manipulates each driven element (lower traveling body 1, rotating platform 3, boom 4, arm 5, bucket 6, and the like). In other words, the manipulation device 45 is the manipulation unit that manipulates each hydraulic actuator that drives each driven element. The manipulation device 45 includes, for example, a lever, a pedal, and various buttons, and outputs a manipulation signal corresponding to a manipulation content to the controller 30.

Further, the manipulation device 45 may also be the manipulation unit that manipulates the imaging device 40, the distance sensor 41, the operation/posture state sensor 42, the position sensor 43, the orientation sensor 44, the display unit 50, the voice output unit 60, the communication device 80, and the like, and outputs a manipulation command for each of these parts to the controller 30.

The display unit 50 is provided around the cab seat in the cabin 10, and displays various types of image information to be notified to the operator under the control of the controller 30. The display unit 50 is, for example, a liquid crystal display or an organic electroluminescence (EL) display, and may be a touch-panel type that also serves as at least a part of the manipulation device 45.

The voice output unit 60 is provided around the cab seat in the cabin 10, and outputs various types of voice information to be notified to the operator under the control of the controller 30. The voice output unit 60 is, for example, a speaker, or a buzzer.

The communication device 80 is a communication device that transmits and receives various types of information to and from a remote external device, another excavator 100, or the like through a predetermined communication network NW, based on a predetermined wireless communication standard. The communication network NW may include, for example, a mobile communication network with a base station as an end, a satellite communication network that uses a communication satellite in the sky, a short-range communication network that conforms to a protocol such as WiFi or Bluetooth (registered trademark), and an Internet communication network.

The controller 30 is a control device that controls the operation of each part of the excavator 100 to control the drive of the excavator 100. The controller 30 is mounted inside the cabin 10. A function of the controller 30 may be realized by any hardware, software, or a combination thereof. For example, the controller 30 is mainly configured of a microcomputer including a CPU, a RAM, a ROM, an I/O, and the like. In addition to these, the controller 30 may be configured to include, for example, an FPGA or an ASIC.

Further, the controller 30 includes a storage unit 35, as a storage area, defined in an internal memory such as an electrically erasable programmable read-only memory (EEPROM).

The storage unit 35 stores various programs and various types of data for operating each part of the excavator 100, and also functions as a work area of the controller 30. The storage unit 35 of the present embodiment stores in advance a program that executes operation control processing described below.

Further, the excavator 100 can mutually communicate with the management device 200 and the terminal device 300 through the predetermined communication network NW.

The management device 200 is disposed at a position geographically separated from a user or the like who owns the excavator 100 and the terminal device 300. The management device 200 is, for example, a server device that is installed in a management center or the like provided outside a work site where the excavator 100 works and is mainly configured of one or a plurality of server computers. In this case, the server device may be an in-house server operated by a business operator operating the system or a related business operator relating to the business operator, or may be a rental server. Further, the server device may be a so-called cloud server. Further, the management device 200 may be a server device (so-called edge server) disposed in a management office or the like in the work site of the excavator 100, or may be a stationary or portable general-purpose computer terminal.

As described above, the management device 200 can mutually communicate with each of the excavator 100 and the terminal device 300 through the communication network NW. Accordingly, the management device 200 can receive and store (accumulate) various types of information uploaded from the excavator 100. Further, the management device 200 can transmit various types of information to the terminal device 300 in response to a request from the terminal device 300. Further, the management device 200 manages (stores) information regarding the plurality of excavators 100 by associating the information with ID information of each excavator 100 or the like such that the information can be identified for each excavator 100. The management device 200 may be able to remotely manipulate the excavator 100.

The terminal device 300 (an example of information processing device) is a user terminal used by the user. The user may include, for example, a supervisor and a manager of the work site, the operator of the excavator 100, a manager of the excavator 100, a serviceman of the excavator 100, and a developer of the excavator 100. The terminal device 300 may be able to remotely manipulate the excavator 100. The terminal device 300 is, for example, a general-purpose portable terminal such as a laptop-type computer terminal, a tablet terminal, or a smartphone owned by the user. Further, the terminal device 300 may be a stationary general-purpose terminal such as a desktop computer. Further, the terminal device 300 may be a dedicated terminal (portable terminal or stationary terminal) for receiving information provision.

The terminal device 300 can mutually communicate with the management device 200 through the communication network NW. Accordingly, the terminal device 300 can receive the information transmitted from the management device 200 and provide the information to the user through the display unit mounted on the terminal device 300. Further, the terminal device 300 may be configured to be mutually communicable with the excavator 100 through the communication network NW.

Operation Control Processing

Subsequently, operation control processing of controlling the operation of the excavator 100 will be described.

Figure 4:
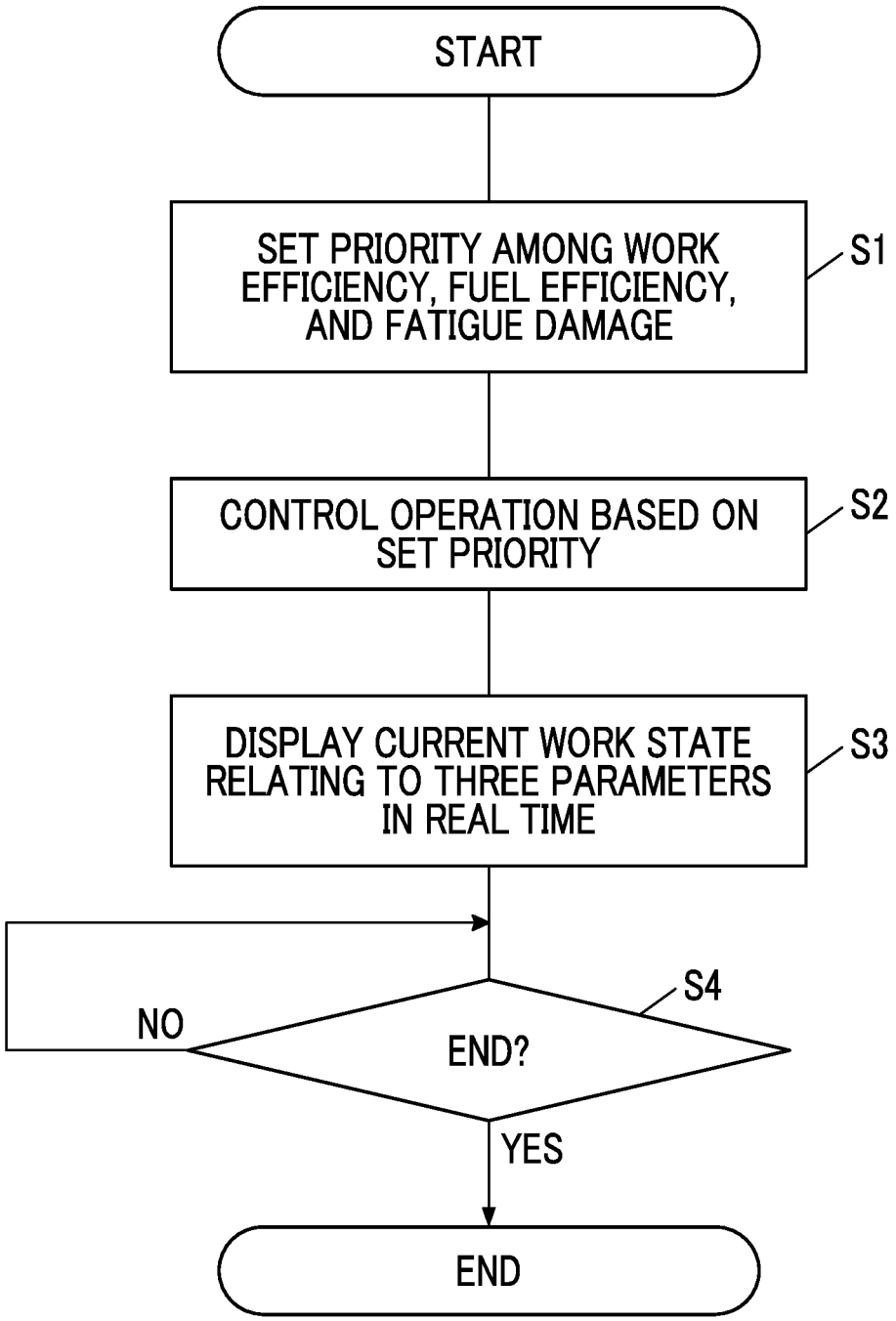
FIG. 4 is a flowchart showing a flow of operation control processing according to an embodiment of the present invention.
Figure 5:
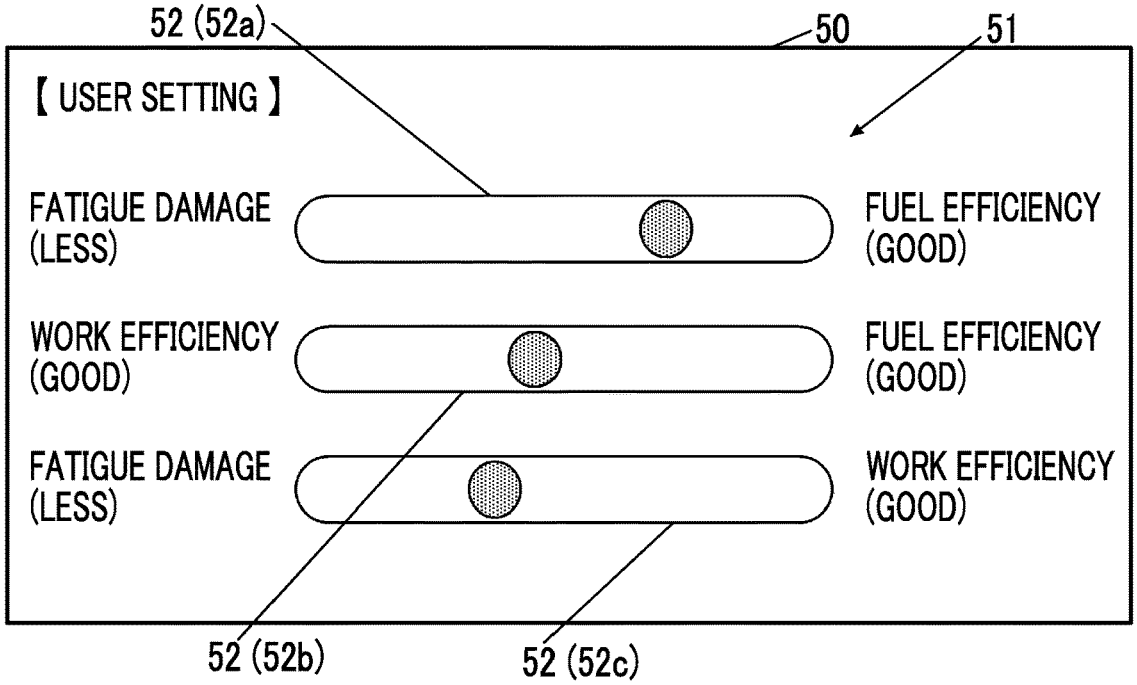
FIG. 5 is a diagram showing a display example of a display unit in the operation control processing according to an embodiment of the present invention.
Figure 6:
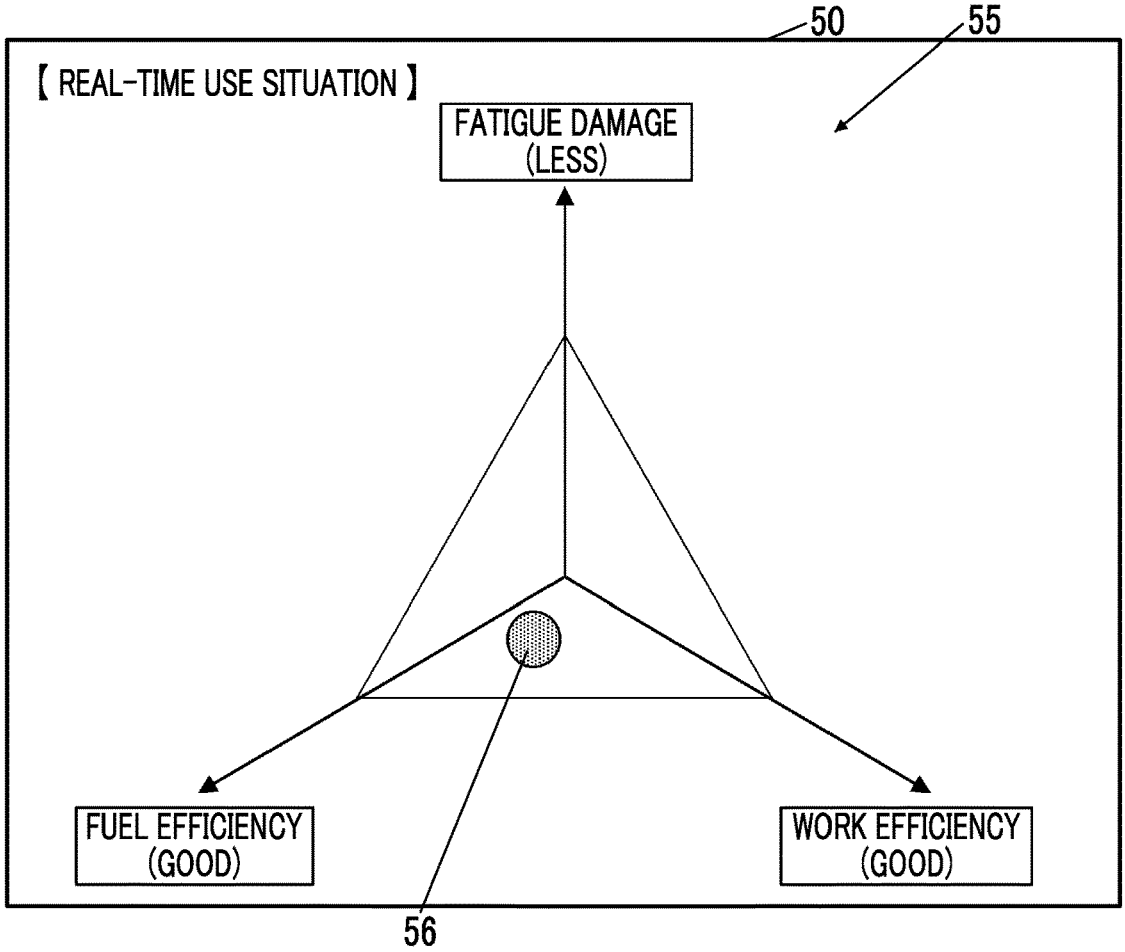
FIG. 6 is a diagram showing a display example of the display unit in the operation control processing according to an embodiment of the present invention.

FIG. 4 is a flowchart showing a flow of the operation control processing. FIGS. 5 and 6 are diagrams showing display examples of the display unit 50 in the operation control processing.

The operation control processing is processing of controlling the operation of the excavator 100 based on a condition set by the operator. For example, the operation control processing is executed by the controller 30 developing a predetermined program stored in the storage unit 35, based on the manipulation of the operator.

Here, as the operation performed by the excavator 100, a predetermined operation (for example, excavation operation) by the fully automatic machine control function is autonomously executed.

Since the machine control function is a known technique in the related art, detailed description thereof will be omitted, and the machine control function will be briefly described below.

For example, in a case where the operator manually performs an excavation manipulation, a leveling manipulation, or the like on the ground, the controller 30 causes at least one of the boom 4, the arm 5, or the bucket 6 to automatically operate such that a target construction surface matches a tip part of the attachment AT, specifically, a position serving as a control reference (hereinafter simply referred to as "control reference"), which is set at a work portion of the bucket 6. The control reference may include, for example, a plane or a curved surface constituting a tiptoe as the work portion of the bucket 6, a line segment defined on the plane or the curved surface, and a point defined on the plane or the curved surface. Further, the control reference may include, for example, a plane or a curved surface constituting a back surface as the work portion of the bucket 6, a line segment defined on the plane or the curved surface, and a point defined on the plane or the curved surface.

Specifically, in a case where the operator performs a predetermined arm manipulation, the controller 30 causes the boom 4, the arm 5, and the bucket 6 to automatically operate such that the target construction surface matches the control reference of the bucket 6 in response to the manipulation of the arm 5 by the operator. Accordingly, the operator can cause the excavator 100 to execute the excavation work, the leveling work, or the like along the target construction surface with a simple manipulation.

For example, the work portion of the bucket 6 may be set according to a setting input by an operator or the like, or may be automatically set according to the work content of the excavator 100. Specifically, in a case where the work content of the excavator 100 is the excavation work or the like, the work portion of the bucket 6 may be set to the tiptoe of the bucket 6. In a case where the work content of the excavator 100 is the leveling work, compaction work, or the like, the work portion of the bucket 6 may be set on the back surface of the bucket 6. In this case, the work content of the excavator 100 may be automatically determined based on the image captured by the imaging device 40, or may be set by selection or input by the operator or the like.

As shown in FIG. 4, in a case where the operation control processing is executed, first, the controller 30 sets a priority (degree of priority) among work efficiency, energy consumption efficiency (fuel efficiency in the present embodiment), and metal fatigue damage, based on the manipulation of the operator (step S1).

The work efficiency corresponds to, for example, a work time required for the excavator 100 to complete predetermined unit work. The energy consumption efficiency corresponds to, for example, a fuel consumption rate (fuel efficiency) of an engine 11. The metal fatigue damage (hereinafter simply referred to as "fatigue damage") is a degree of decrease in strength that is accumulated in a case where a component of the excavator 100 is continuously (or repeatedly) subjected to mechanical stress. The fatigue damage of resin, ceramics, or the like, in addition to the metal, may be included.

Specifically, for example, as shown in FIG. 5, the controller 30 causes the display unit 50 to display a setting screen 51 for setting the priority among the three parameters (work efficiency, energy consumption efficiency (fuel efficiency), and fatigue damage). The controller 30 sets the priority among the three parameters based on the setting manipulation of the operator to the setting screen 51. In the example of FIG. 5, the setting screen 51 displays three sliders 52 that receive the manipulation of the operator. The three sliders 52 are a first slider 52*a* that sets the priority between the fatigue damage and the fuel efficiency, a second slider 52*b* that sets the priority between the work efficiency and the fuel efficiency, and a third slider 52*c* that sets the priority between the fatigue damage and the work efficiency.

However, the three parameters are not independent of each other. In a case where one or two of the three parameters are set, the rest is decided. For example, a trade-off relationship is established between work efficiency and fuel efficiency. Further, fatigue strength of a structure has a characteristic that the fatigue damage is less likely to be accumulated as a fluctuation load is smaller. For example, total fatigue damage can be reduced in a case of excavation of 10 tons of earth and sand in 20 passes as compared with a case of excavation of 10 tons of earth and sand in 10 passes. However, the work efficiency or the fuel efficiency is considered to be lowered. A limit value (upper limit or lower limit) may be set for each priority among the three parameters.

Next, the controller 30 controls the operation of the vehicle body BD based on the priority set in step S1 (step S2).

Here, the operation of the vehicle body BD includes the excavation operation, a traveling operation, and an impact operation (G operation). The "excavation operation" among the above operations refers to a series of operations of "excavation, lifting, turning, and soil removal". The "impact operation" refers to an operation (excluding the excavation operation and the traveling operation) in which an impact acts on the vehicle body BD, such as falling from a slightly high place.

In this step, the controller 30 decides the operation content of the excavator 100 according to the priority among the three parameters. The controller 30 controls the operation of the excavator 100 by the machine control function to realize the operation content thereof. For example, at the time of the excavation of the excavator 100, the controller 30 sets a target trajectory of the work portion of the bucket 6, a posture angle of the bucket 6 with respect to a reference plane (for example, the ground), and the like according to the relative priority among the three parameters. The controller 30 controls the operation of the attachment AT and the like along the set target trajectory of the bucket 6 and posture angle of the bucket 6 with respect to the ground.

In this case, a fatigued portion where the fatigue damage is accumulated is different depending on the operation. For example, a main fatigued portion in a case of the excavation operation is the attachment AT, and the main fatigued portion in cases of the traveling operation and the impact operation is the lower traveling body 1. For the fatigued portion, which is associated with an operation, where fatigue is most accumulated, the controller 30 calculates and obtains the fatigue damage caused by the operation. However, the fatigue damage in a portion other than the fatigued portion where the fatigue is most accumulated may be taken into consideration. A known method in the related art can be used as a specific method of calculating the fatigue damage.

At the time of the execution of the operation control in step S2, the controller 30 displays a current work state relating to the three parameters (work efficiency, fuel efficiency, and fatigue damage) in real time (step S3).

Specifically, for example, as shown in FIG. 6, the controller 30 causes the display unit 50 to display a real-time display screen 55 for displaying an operation point 56 (point corresponding to the above-described priority) of the excavator 100 relating to the three parameters. In the example of FIG. 6, the work is performed in a state where the fuel efficiency and the work efficiency are good, but the fatigue damage is large. The operator checks the real-time display screen 55 to adjust the priority among the three parameters as necessary.

Next, the controller 30 determines whether or not to end the operation control processing (step S4). In a case where the controller 30 determines not to end the operation control processing (step S4; No), step S4 is repeated.

In a case where the operation control processing is determined to be ended due to the completion of the excavation work, for example (step S4; Yes), the controller 30 ends the operation control processing.

Technical Effects of Present Embodiment

As described above, according to the present embodiment, the operation of the vehicle body BD having the attachment AT is controlled based on the degree of priority among the work efficiency, the energy consumption efficiency, and the metal fatigue damage.

Accordingly, the operation of the excavator 100 can be controlled in consideration of the metal fatigue damage in addition to the work efficiency and the energy consumption efficiency. Therefore, the operation of the excavator 100 can be suitably controlled.

Further, according to the present embodiment, in a case where the operation of the vehicle body BD is controlled, the display unit 50 displays the degree of priority (operation point 56) among the work efficiency, the fuel efficiency, and the fatigue damage in a current operation state.

Accordingly, the operator can grasp the current work state regarding the three parameters (work efficiency, fuel efficiency, and fatigue damage), and can adjust the current work state as necessary.

Other

The embodiment according to the present invention has been described above. However, the present invention is not limited to the above-described embodiment and a modification example thereof.

For example, in the above-described embodiment, the predetermined operation by the machine control function is controlled based on the priority among the three parameters. However, the operation of the excavator 100 to be controlled is not limited to the fully automatic operation function by the machine control function or the like, and includes operation control of assisting (to realize the set priority) the so-called semi-automatic operation function or a manual operation by the operator.

Further, in the above-described embodiment, the priority among the three parameters is set based on the manipulation of the operator (manipulation that affects the priority value). However, the priority may be automatically set by the controller 30 based on, for example, a state of the excavator 100.

Alternatively, the user who manipulates the terminal device 300, instead of the operator boarding the excavator 100, may set the priority among the three parameters.

Further, the work machine according to an embodiment of the present invention is not limited to the excavator, and can be suitably applied to all work machines having the work element.

In addition, changes can be made to the detailed parts shown in the embodiment without departing from the concept of the invention.

It should be understood that the invention is not limited to the above-described embodiment, but may be modified into various forms on the basis of the spirit of the invention. Additionally, the modifications are included in the scope of the invention.

What is claimed is:

1. A work machine comprising:

a machine body having a work element;

a display unit; and a control unit configured to:

set a degree of priority among work efficiency, energy consumption efficiency, and metal fatigue damage, based on a user manipulation and a relationship between two of the work efficiency, the energy consumption efficiency, and the metal fatigue damage;

control an operation of the machine body based on the degree of priority among the work efficiency, the energy consumption efficiency, and the metal fatigue damage;

cause the display unit to display a setting screen for setting the degree of priority; and set, based on a manipulation of an operator of the setting screen, a first degree of priority between the metal fatigue damage and the energy consumption efficiency, a second degree of priority between the work efficiency and the energy consumption efficiency, and a third degree of priority between the metal fatigue damage and the work efficiency.

2. The work machine according to claim 1, wherein the control unit calculates a value of a portion corresponding to the operation of the machine body as the metal fatigue damage.

3. The work machine according to claim 1, wherein the control unit causes, in a case where the operation of the machine body is controlled, the display unit to display the degree of priority among the work efficiency, the energy consumption efficiency, and the metal fatigue damage in a current operation state.

4. The work machine according to claim 1, wherein the machine body includes the work element and an undercarriage, and the operation of the machine body includes a work operation, a traveling operation, and an impact operation.

5. The work machine according to claim 1, wherein the work element is an attachment including a boom, an arm, and a bucket.

6. The work machine according to claim 5, wherein the arm is attached to a tip of the boom to be rotatable up and down, and the bucket is attached to a tip of the arm to be rotatable up and down.

7. The work machine according to claim 5, wherein the boom, the arm, and the bucket are hydraulically driven by a boom cylinder, an arm cylinder, and a bucket cylinder, as hydraulic actuators.

8. The work machine according to claim 7, wherein the machine body includes an undercarriage that causes the work element and the machine body to travel and a turning body that turns with respect to the undercarriage, and the boom is attached to the turning body to be vertically movable.

9. The work machine according to claim 1, further comprising:

an imaging device that outputs an image captured of a periphery of the work machine to the control unit; and a distance sensor that measures a distance to an object near the work machine.

10. The work machine according to claim 9, wherein the imaging device is installed such that an optical axis faces a ground direction, and the distance sensor is provided such that a rear side, a left side, and a right side of the work machine can be measured in correspondence with the imaging device.

11. The work machine according to claim 1, further comprising:

a manipulation unit that manipulates a hydraulic actuator that drives the work element and an undercarriage of the work machine.

12. The work machine according to claim 11, wherein the manipulation unit is provided near a cab seat of a cabin and outputs a manipulation signal corresponding to a manipulation content to the control unit.

13. The work machine according to claim 1, wherein the setting screen displays a first slider for setting the first degree of priority, a second slider for setting the second degree of priority, and a third slider for setting the third degree of priority.

14. An information processing device capable of communicating with a work machine including a machine body, the information processing device comprising a display unit, wherein the information processing device is configured to:

set a degree of priority among work efficiency, energy consumption efficiency, and metal fatigue damage, based on a user manipulation and a relationship between two of the work efficiency, the energy consumption efficiency, and the metal fatigue damage;

control an operation of the machine body based on the degree of priority among the work efficiency, the energy consumption efficiency, and the metal fatigue damage;

cause the display unit to display a setting screen for setting the degree of priority; and set, based on a manipulation of an operator of the setting screen, a first degree of priority between the metal fatigue damage and the energy consumption efficiency, a second degree of priority between the work efficiency and the energy consumption efficiency, and a third degree of priority between the metal fatigue damage and the work efficiency.

15. The information processing device according to claim 14, wherein the setting screen displays a first slider for setting the first degree of priority, a second slider for setting the second degree of priority, and a third slider for setting the third degree of priority.

* * * * *